US009215893B2

(12) United States Patent
Izumiya et al.

(10) Patent No.: US 9,215,893 B2
(45) Date of Patent: Dec. 22, 2015

(54) MACHINE AND METHOD OF MANUFACTURING LOW IGNITION PROPENSITY PAPER BY MAINTAINING SHRINKAGE RATE OF DRIED WEB WITHIN ALLOWABLE RANGE

(75) Inventors: Takafumi Izumiya, Tokyo (JP); Shinzo Kida, Tokyo (JP); Keisuke Towatari, Tokyo (JP); Masaaki Fukaya, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 148 days.

(21) Appl. No.: 13/614,550

(22) Filed: Sep. 13, 2012

(65) Prior Publication Data

US 2013/0011546 A1 Jan. 10, 2013

Related U.S. Application Data

(63) Continuation of application No. PCT/JP2010/055224, filed on Mar. 25, 2010.

(51) Int. Cl.

| | |
|---|---|
| ***B05C 11/00*** | (2006.01) |
| ***A24C 5/00*** | (2006.01) |
| ***B05C 11/10*** | (2006.01) |
| ***B05B 12/08*** | (2006.01) |
| ***A24D 1/02*** | (2006.01) |
| ***D21H 21/34*** | (2006.01) |
| ***D21H 23/22*** | (2006.01) |
| ***D21H 27/00*** | (2006.01) |

(52) U.S. Cl.

CPC ..... *A24C 5/005* (2013.01); *A24D 1/025* (2013.01); *B05B 12/08* (2013.01); *B05C 11/1015* (2013.01); *D21H 21/34* (2013.01); *D21H 23/22* (2013.01); *D21H 27/00* (2013.01)

(58) Field of Classification Search

CPC ..... A24C 5/00; A24C 5/002; A24C 1/04; A24D 1/025; B65B 2220/06; B65B 41/12; B05C 11/1015; B05B 12/08

USPC ..... 131/284; 356/429; 382/141; 118/673, 118/708, 712; 427/8

See application file for complete search history.

(56) References Cited

U.S. PATENT DOCUMENTS

| | | | | |
|---|---|---|---|---|
| 3,615,048 | A * | 10/1971 | Martin | 226/20 |
| 4,103,596 | A * | 8/1978 | Molins | 493/39 |
| 4,798,136 | A * | 1/1989 | Tittgemeyer et al. | 101/181 |

(Continued)

FOREIGN PATENT DOCUMENTS

| | | | |
|---|---|---|---|
| JP | 4-289298 | A | 10/1992 |
| JP | 2004-115975 | A | 4/2004 |

(Continued)

*Primary Examiner* — Karl Kurple

(74) *Attorney, Agent, or Firm* — Birch, Stewart, Kolasch & Birch, LLP

(57) ABSTRACT

There is provided a machine of manufacturing a low fire-spreading web, having a travel path (2) through which a paper web (W) travels; an applicator (3) that is interposed in the travel path (2) and used to apply a combustion inhibitor (7) onto the web (W); and a dryer (4) that dries the web (W) applied with the combustion inhibitor (7), further including a detector (9) that measures a parameter indicative of width of the web (W) that has passed through the dryer (4); and a controller (10) that controls a drying condition of the dryer (4) on the basis of a measurement result obtained by the detector (9) so that the width of the web (W) falls within an allowable range.

7 Claims, 3 Drawing Sheets

(56) References Cited

U.S. PATENT DOCUMENTS 4,845,374 A * 7/1989 White et al. ..... 250/559.4
4,941,182 A * 7/1990 Patel ..... 382/141
4,945,252 A * 7/1990 Lerner et al. ..... 250/548
5,001,353 A * 3/1991 Odake et al. ..... 250/461.1
5,197,800 A * 3/1993 Saidman et al. ..... 366/136
5,214,442 A * 5/1993 Roller ..... 347/102
5,239,376 A * 8/1993 Dittmann et al. ..... 348/88
5,305,099 A * 4/1994 Morcos ..... 348/88
5,377,428 A 1/1995 Clark
5,407,132 A * 4/1995 Messerly et al. ..... 239/124
5,474,095 A 12/1995 Allen et al.
5,579,693 A * 12/1996 Carreira et al. ..... 101/424.1
5,632,201 A * 5/1997 Roch ..... 101/211
5,902,431 A * 5/1999 Wilkinson et al. ..... 156/159
6,026,172 A * 2/2000 Lewis et al. ..... 382/106
6,198,537 B1 * 3/2001 Bokelman et al. ..... 356/429
6,266,437 B1 * 7/2001 Eichel ..... G06T 7/001 348/125
6,805,133 B2 * 10/2004 Matsumura et al. ..... 131/68
7,121,496 B2 * 10/2006 Jackson ..... 242/563.1
7,297,371 B2 * 11/2007 Simmons ..... B05D 1/025 222/146.1
7,408,570 B2 * 8/2008 Guha ..... G01N 21/89 250/559.08
7,434,585 B2 * 10/2008 Holmes ..... 131/281
8,000,501 B2 * 8/2011 Huotilainen ..... 382/108
8,069,859 B2 * 12/2011 Minami ..... A24D 1/025 131/284
8,256,345 B2 * 9/2012 Denninger et al. ..... 101/424.1
8,405,831 B2 * 3/2013 Carlson et al. ..... 356/429
8,568,896 B2 * 10/2013 Kida ..... A24D 1/025 162/139
2001/0006067 A1 * 7/2001 Saitou ..... 131/88
2003/0096061 A1 5/2003 Garg et al.
2004/0164484 A1 * 8/2004 Mizuno ..... B65H 5/34 271/270
2004/0182407 A1 9/2004 Peterson et al.
2005/0028832 A1 * 2/2005 Kubo et al. ..... 131/284
2007/0029060 A1 * 2/2007 Murray et al. ..... 162/134
2007/0051381 A1 * 3/2007 Hancock et al. ..... 131/284
2007/0052964 A1 * 3/2007 Uesugi et al. ..... 356/430
2007/0201916 A1 * 8/2007 Ueno ..... G03G 15/2042 399/334
2007/0289690 A1 * 12/2007 Yasuda ..... B32B 18/00 156/89.11
2009/0007630 A1 * 1/2009 Kawasaki ..... G03G 15/5029 73/12.01
2009/0059232 A1 * 3/2009 Hellstrom et al. ..... 356/429
2010/0297351 A1 11/2010 Kida et al.
2011/0243636 A1 * 10/2011 Viturro et al. ..... 400/583
2012/0090799 A1 * 4/2012 Kida et al. ..... 162/139
2012/0328772 A1 * 12/2012 Kida et al. ..... 427/8
2013/0094043 A1 * 4/2013 Ikari ..... H04N 1/02815 358/1.13

FOREIGN PATENT DOCUMENTS

JP 2004-512849 A 4/2004
JP 2005-511902 A 4/2005
TW 200948292 A1 12/2009
WO WO 2009/099011 A1 8/2009

* cited by examiner

MACHINE AND METHOD OF MANUFACTURING LOW IGNITION PROPENSITY PAPER BY MAINTAINING SHRINKAGE RATE OF DRIED WEB WITHIN ALLOWABLE RANGE

CROSS REFERENCE TO RELATED APPLICATION

This application is a Continuation of PCT International Application No. PCT/JP2010/055224 filed on Mar. 25, 2010, which is hereby expressly incorporated by reference into the present application.

TECHNICAL FIELD

The present invention relates to a machine and method of manufacturing a low fire-spreading web that provides a low fire-spreading property to cigarettes, and a method of manufacturing a low fire-spreading wrapping paper used for cigarettes.

BACKGROUND ART

A low fire-spreading wrapping paper used for cigarettes has lately grown popular. This low fire-spreading wrapping paper prevents fire from spreading to a combustible material in the event that a lighted cigarette using the wrapping paper is dropped on the combustible material. The cigarette includes smoking material such as shred tobacco, and paper wrapping the smoking material. This paper is the low fire-spreading wrapping paper (for example, see FIG. 2 of Patent Document 1).

More specifically, the low fire-spreading wrapping paper disclosed in Patent Document 1 includes a paper web and bands that are longitudinally arranged in the web at predetermined intervals. These bands are formed by applying a combustion inhibitor onto the web. The combustion inhibitor is generally applied as an aqueous solution. The web applied with the combustion inhibitor is dried by a dryer to be formed into a low fire-spreading wrapping paper.

After being dried, the wrapping paper is reduced in width as a result of drying shrinkage by about 3 percent to about 7 percent. For example, if the original width of the wrapping paper is 1040 mm, the paper width will become 1010 mm at a shrinkage rate of 3 percent, and 970 mm at a shrinkage rate of 7 percent. The dried web is provided with slits of 27 mm wide, and is wound into rolls as wrapping papers each having a width of 27 mm. While the wrapping paper dried at a 3 percent shrinkage rate can make 37 rolls of 27 mm slits, the one dried at a 7 percent shrinkage rate makes 35 rolls. In this way, the different shrinkage rates produce different numbers of wrapping paper rolls, which destabilizes the manufacture. Moreover, because the combustion inhibitor applied onto the web are fixed in amount and application intervals, if the number of the produced rolls is different from wrapping paper to wrapping paper, the application amount of the combustion inhibitor is also unequal from roll to roll. This results in a failure of producing wrapping papers of the stable quality.

In order to maintain a constant shrinkage rate, drying temperature and web tension are controlled. However, it is necessary to change the temperature setting with the seasons, and also from morning to afternoon. It is thus troublesome to maintain the constant shrinkage rate.

PRIOR ART DOCUMENT

Patent Document

Patent Document 1
Japanese Patent Publication (Kohyo) No. 2004-512849

SUMMARY OF THE INVENTION

Problem to be Solved by the Invention

The invention has been made in light of the above-mentioned conventional art. It is an object of the invention to provide a machine and method of manufacturing a low fire-spreading web that is capable of maintaining a constant shrinkage rate after being dried, regardless of surrounding environments, and a method of manufacturing a low fire-spreading wrapping paper used for cigarettes.

Means for Solving the Problem

In order to accomplish the above object, the invention provides a machine of manufacturing a low fire-spreading web, having a travel path through which a paper web travels; an applicator that is interposed in the travel path and used to apply a combustion inhibitor onto the web; and a dryer that dries the web applied with the combustion inhibitor. The machine further has a detector that measures a parameter indicative of width of the web that has passed through the dryer; and a controller that controls a drying condition of the dryer on the basis of a measurement result obtained by the detector so that the width of the web falls within an allowable range.

According to a preferred aspect, the detector is a sensor that directly measures the width of the web.

According to a preferred aspect, the controller has a calculating section that receives a measurement result from the sensor and finds a shrinkage rate in a width direction of the web, a determining section that makes a determination as to whether the shrinkage rate is within a preset range, and a controlling section that changes the drying condition of the dryer when the shrinkage rate is outside the preset range.

According to a preferred aspect, the sensor is a CCD laser transmission sensor.

According to a preferred aspect, the drying condition is drying temperature.

According to a preferred aspect, the drying temperature is an in-furnace temperature in the dryer or hot-air temperature of hot air supplied into the drying furnaces.

According to a preferred aspect, the applicator includes first and second tanks that communicate with each other and contain the combustion inhibitor; a supply path for supplying the combustion inhibitor from the first tank; an application unit for directly applying onto the web the combustion inhibitor supplied through the supply path; a capacity measurer for measuring a capacity of the combustion inhibitor in the first tank while the combustion inhibitor is being applied onto the web; and an adjusting unit that adjusts the capacity of the combustion inhibitor supplied from the second tank to the first tank so that the capacity of the combustion inhibitor in the first tank, which is obtained by the capacity measurer, is constant.

According to a preferred aspect, the machine further includes, as the detector, a moisture meter that measures a moisture content of the web.

The invention further provides a method of manufacturing a low fire-spreading web, including an applying step that makes the paper web travel along the travel path and applies a combustion inhibitor onto the web; and a drying step that dries the web applied with the combustion inhibitor. The method further includes a controlling step that, after the drying step, measures the width of the web and controls a drying condition in the drying step on the basis of the measurement result so that the width of the web falls within an allowable range.

According to a preferred aspect, the web is applied with the combustion inhibitor having constant viscosity in the applying step.

The invention further provides a method of manufacturing a low fire-spreading wrapping paper used for cigarettes, in which the low fire-spreading web undergoes an unwrinkling step that takes wrinkles and a slit-forming step that forms slits in the web that has been unwrinkled and cuts the web into predetermined width, and is formed into wrapping paper for cigarettes.

Technical Advantage of the Invention

The manufacturing machine of the low fire-spreading web according to the invention has the detector that measures the parameter indicative of the width of the web that has passed through the dryer, and the controller that controls the drying condition of the dryer on the basis of the measurement result obtained by the detector so that the web width falls within the allowable range. The drying condition can therefore be properly controlled to achieve a predetermined shrinkage rate, reflecting the width of the dried web (shrinkage rate). This makes it possible to manufacture the wrapping paper of the stable quality in the future.

As the detector, in particular, a sensor that actually measures the web width is utilized.

Having the calculating, determining, and controlling sections, the controller is capable of accurately recognizing the state of the web by finding the shrinkage rate of the dried web, and based upon this, changing the drying condition. Consequently, the wrapping paper of the more stable quality can be manufactured.

Using the CCD laser transmission sensor as the sensor enables the web width to be measured with accuracy.

Moreover, since the specific parameter controlled by the controller is the drying temperature, the web with a desired shrinkage rate can be produced by a simple method.

The drying temperature to be controlled is the in-furnace or hot-air temperature, so that the web with the desired shrinkage rate can be properly produced by a simple method.

Because of the constant capacity of the combustion inhibitor in the first tank installed in the applicator, the combustion inhibitor applied onto the web has constant viscosity. The web passing through the dryer is accordingly constant in quality, leading to the constant quality of the dried web. A change in the shrinkage rate is therefore caused only by the dryer. This means that the shrinkage rate of the web can be precisely maintained constant simply by controlling the drying condition.

Since the moisture meter is provided as the detector, the moisture content of the dried web can be measured with the moisture meter, and the controller controls the drying condition, reflecting the moisture content. The drying condition is thus properly controlled so that the dried web has the predetermined shrinkage rate. This makes it possible to manufacture the wrapping paper of the stable quality in the future.

With the method of manufacturing the low fire-spreading web according to the invention, the drying condition can be properly controlled to achieve the predetermined shrinkage rate, reflecting the width of the dried web (shrinkage rate). This makes it possible to manufacture the wrapping paper of the stable quality in the future.

Moreover, the dried web has constant quality since the viscosity of the combustion inhibitor applied onto the web is maintained constant. As a change in the shrinkage rate of the web is caused only by an influence of the drying step, the shrinkage rate can be accurately maintained constant simply by the control of the drying condition.

With the method of manufacturing the low fire-spreading wrapping paper according to the invention, the wrapping paper for cigarettes is manufactured with the web that is produced to have a stable shrinkage rate, through the unwrinkling step that takes wrinkles and the slit-forming step that forms the slits in the unwrinkled web and cuts the web into the predetermined width. Consequently, the low fire-spreading wrapping paper of the stable quality can be manufactured.

BEST MODE FOR CARRYING OUT THE INVENTION

Figure 1:
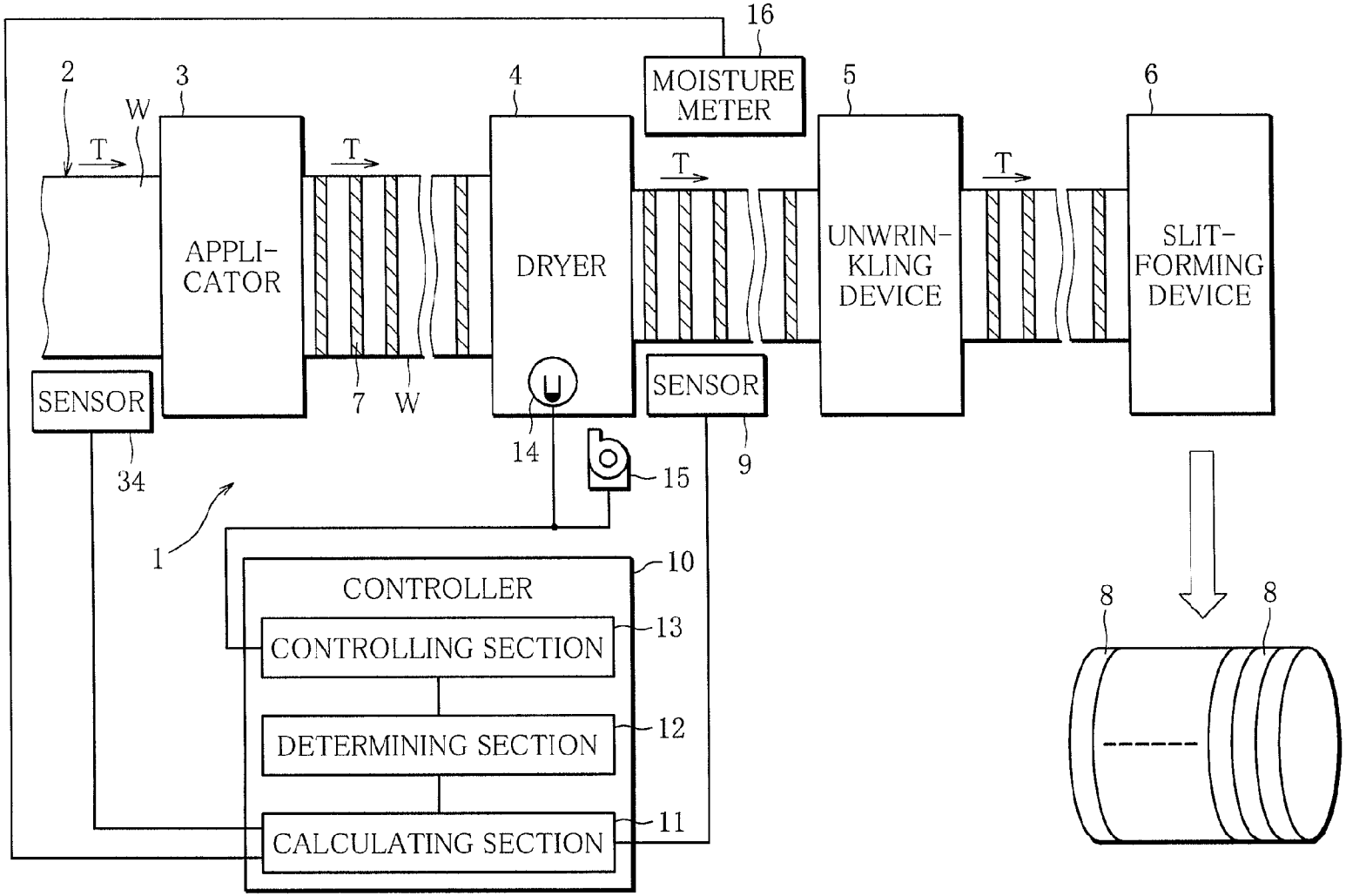
FIG. 1 is a schematic view of a machine of manufacturing a low fire-spreading wrapping paper according to the invention.

FIG. 1 is a schematic plan view. A machine of manufacturing a low fire-spreading web according to the invention is a part of a manufacturing machine 1 of a low fire-spreading wrapping paper. The manufacturing machine 1 includes a travel path 2, an applicator 3, a dryer 4, an unwrinkling device 5, and a slit-forming device 6. The machine of manufacturing a low fire-spreading web is formed of the applicator 3, the dryer 4, and a controller 10 mentioned later. The applicator 3, the dryer 4, the unwrinkling device 5, and the slit-forming device 6 are all situated on the travel path 2. Web W made of paper is reeled out from an original roll (not shown) that is a winding of the web W so as to travel through the travel path 2 in a direction of arrow T. The paper width of the web W is first measured by a sensor 34. The web W then passes through the applicator 3. The applicator 3 partially applies a combustion inhibitor 7 onto the web W. The combustion inhibitor 7 is applied onto a plurality of places of the web W at longitudinally spaced intervals to extend across the web W in the width direction. The web W applied with the combustion inhibitor passes through the dryer 4. The dryer 4 is equipped with a plurality of drying furnaces (not shown). The web W passes through these drying furnaces to be dried. After being dried, the web W is unwrinkled by the unwrinkling device 5. The web W is then provided with slits by the slit-forming device 6, and is formed into rolls of wrapping paper 8.

A sensor 9 serving as a detector is placed near the outlet of the dryer 4. The sensor 9 measures the width of the web W that has passed through the dryer 4. The sensor 9 is connected to the controller 10. The controller 10 controls a drying condition, and is connected to the dryer 4. In short, the controller 10 controls the drying condition of the dryer 4 so that the width of the web W falls within an allowable range on the basis of the measurement result of the sensor 9. The wrapping paper 8 of the stable quality can be manufactured by performing the drying on the proper drying condition, reflecting the width of the dried web W.

To be specific, the controller 10 includes a calculating section 11, a determining section 12, and a controlling section 13. The calculating section 11 receives the measurement results of parameters indicative of the widths (actual widths of the web W) from the sensors 34 and 9, and finds a width shrinkage rate of the dried web W. To that end, the sensors 34 and 9 are directly connected to the calculating section 11. The determining section 12 makes a determination as to whether the shrinkage rate of the dried web W is within a preset range. The preset range of the shrinkage rate is properly changed depending upon the wrapping paper to be manufactured or various other conditions. The controlling section 13 changes the drying condition of the dryer 4 when the shrinkage rate of the web W is outside the preset range. The shrinkage rate of the dried web W is reflected to the drying condition, so that the web W with a constant shrinkage rate can be produced. As described above, the state of the web W is accurately recognized by finding the shrinkage rate of the dried web W, and based upon this, the drying condition is changed. Consequently, the wrapping paper 8 of a more stable quality can be manufactured. Because of the constant shrinkage rate, the same number of rolls of wrapping paper can be obtained from each original roll. In addition, if a function is preliminarily fixed, the application amount of the combustion inhibitor 7 accordingly becomes uniform with respect of each roll, producing the wrapping paper 8 of the stable quality.

In this specification, the drying condition controlled by the controller 10 is drying temperature. The drying temperature is the temperature to be applied to the web W. The web W with a desired shrinkage rate can be easily obtained simply by changing the temperature condition. More specifically, the drying temperature is an in-furnace temperature in the dryer 4 through which the web W passes or a hot-air temperature of the hot air supplied into the drying furnaces. The in-furnace temperature is changed by various methods, including sending air into the furnaces and heating the furnaces with a heater or the like. The hot-air temperature is changed by changing the temperature of the hot air supplied into the drying furnaces. The controlling section 13 is connected to temperature indicators 14 located in the drying furnaces. The in-furnace temperature is adjusted according to the temperature of the temperature indicators 14. To adjust the hot-air temperature, the controlling section 13 is connected to a hot-air supplier 15 installed in the dryer 4, thereby adjusting a supply temperature. As mentioned above, since the drying temperature to be controlled is the in-furnace or hot-air temperature, the web W with the desired shrinkage rate can be surely produced by a simple method. Preferably, the temperature of the drying furnaces located downstream is set lower than that of the furnaces located upstream, and the downstream drying temperature that influences drying shrinkage is controlled. For example, the upstream drying temperature is set at 130, and the downstream drying temperature 80. A quick response can be made when the controlling section 13 requires a change in the drying condition since the downstream drying temperature is equal to or lower than 100. Consequently, the temperature can be promptly set at a predetermined temperature.

The sensor 9 is a CCD laser transmission sensor. In this case, the sensor 9 is disposed on each of the width-directional sides of the web W that travels through the travel path 2. This CCD laser transmission sensor is a laser displacement sensor. A charge-transfer device called CCD (charge coupled device) is used as a light receiving element. The CCD method detects a light quantity of each pixel of the CCD, and is then capable of accurately detecting a peak position of the light quantity. The width of the web W can be thus measured with accuracy.

A moisture meter 16 serving as a detector is also provided near the outlet of the dryer 4. The moisture meter 16 measures a moisture content of the web W that has passed through the dryer 4. The moisture meter 16 is connected to the calculating section 11 of the controller 10. The calculating section 11 is further capable of finding a moisture content percentage of the web W. The determining section 12 is capable of determining whether the moisture content percentage is within a preset range. When the moisture content percentage is outside the preset range, the controlling section 13 changes the drying condition of the dryer 4 so that the moisture content of the web W falls within the allowable range. In this manner, the moisture content of the dried web W is measured by the moisture meter 16, and the drying condition is controlled by the controller 10 reflecting the moisture content. The drying condition is thus properly controlled so that the dried web W has the predetermined shrinkage rate. In result, the wrapping paper 8 of the stable quality can be manufactured. The control based on the sensor 9 and that based on the moisture meter 16 may be carried out either simultaneously or alternatively.

Figure 2:
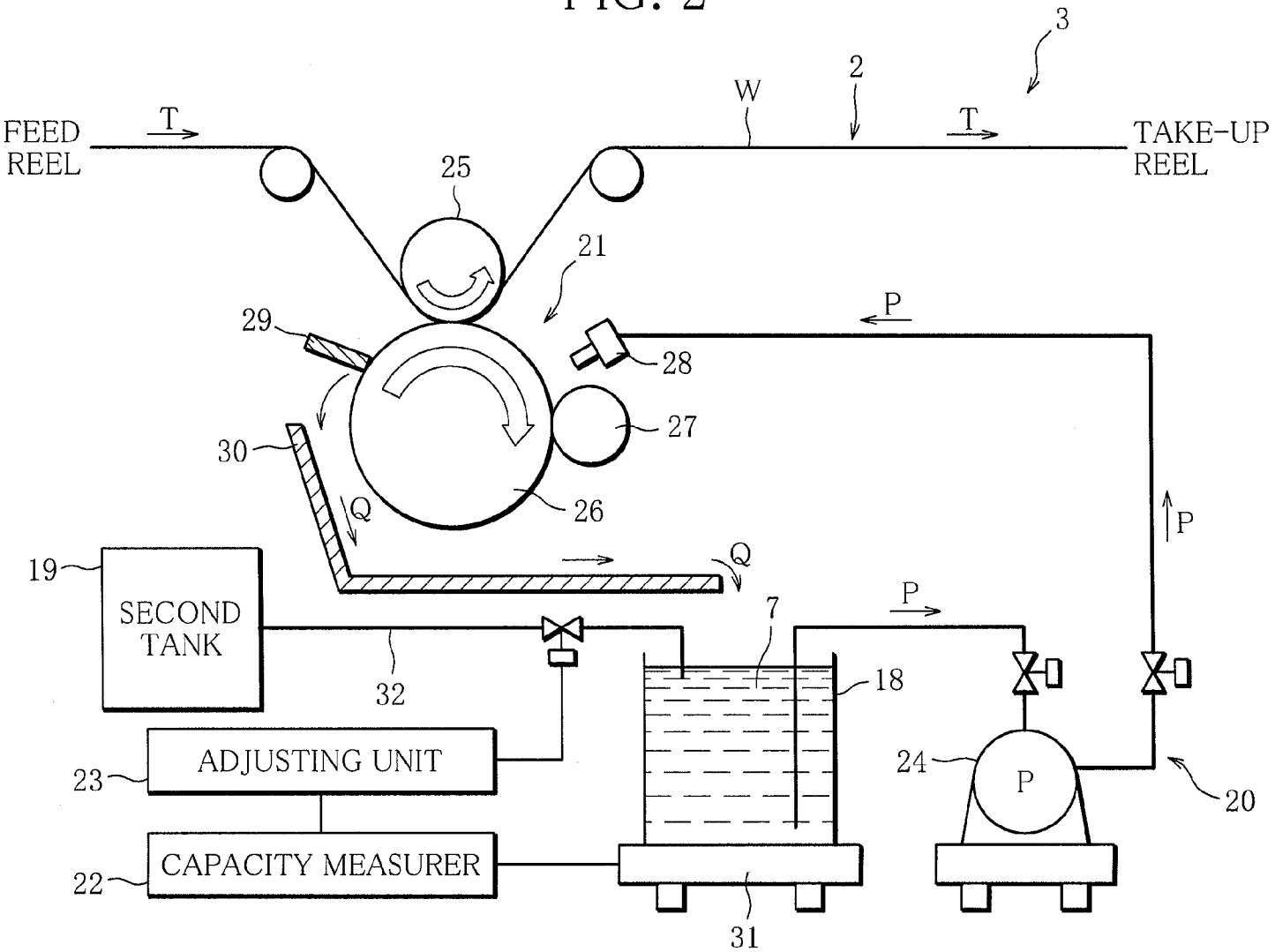
FIG. 2 is a schematic view of an applicator.

As is apparent from FIG. 2, the applicator 3 has a first tank 18, a second tank 19, a supply path 20, an application unit 21, a capacity measurer 22, and an adjusting unit 23. The first and second tanks communicate with each other, and contain the combustion inhibitor 7. The supply path 20 is for supplying the combustion inhibitor 7 from the first tank 18 to the application unit 21. For that reason, a starting end of the supply path 20 is located inside the first tank 18, and the combustion inhibitor 7 in the first tank 18 is sent by a pump 24 to a finishing end in the direction of arrow P. The application unit 21 directly applies onto the web W the combustion inhibitor 7 supplied from the supply path 20.

An application method using the application unit 21 will be described below in detail.

The web W travels through the travel path 2 (FIG. 1). At this time, the web W is reeled out from a feed reel, and is stretched to be taken up by a take-up reel. The application unit 21 includes a platen 25 and a gravure roller 26. The platen 25 and the gravure roller 26 are situated across the travel path 2, or across the web W. They are rotatable in opposite directions to each other. The gravure roller 26 has a flute pattern (not shown) on its outer circumferential surface. The flutes are arranged at regular intervals in a circumferential direction of the gravure roller 26 so that the combustion inhibitor 7 is applied onto a plurality of places at longitudinally spaced intervals to extend across the web W in the width direction.

A furnisher roller 27 is in rotating contact with the outer circumferential surface of the gravure roller 26. A nozzle 28 is located above the furnisher roller 27. The nozzle 28 is connected to the first tank 18 through the supply path 20. While in operation, the pump 24 of the supply path 20 sends the combustion inhibitor in the first tank 18 through the supply path 20 to the nozzle 28. The nozzle 28 supplies the combustion supplier to between the gravure roller 26 and the furnisher roller 27.

A doctor blade 29 is situated near the gravure roller 26. The doctor blade 29 has a tip end in sliding contact with the outer circumferential surface of the gravure roller 26. A recovery chute 30 is disposed under the gravure roller 26 and the doctor blade 29. The recovery chute 30 extends to the first tank 18. The combustion inhibitor 7 that is not applied onto the web W returns to the first tank 18 and is sent again by the pump 24 to the supply path 20.

The doctor blade 29 scrapes extra combustion inhibitor off the outer circumstantial surface of the gravure roller 26. The combustion inhibitor scraped off is returned to the first tank 18 via the recovery chute 30 (in the direction of arrow Q in FIG. 2). While the manufacturing machine 1 is working, the combustion inhibitor in the first tank 18 is in a constant flowing state, circulating between a position at which the combustion inhibitor is applied onto the web W (gravure roller 26) and the first tank 18.

The first tank 18 is placed on a weight scale 31. The weight of the first tank 18, or the capacity of the combustion inhibitor 7, is measured by the capacity measurer 22. The capacity measurer 22 is equipped, for example, with a display. Based upon a measurement result, the display shows a remaining amount, or consumed amount, of the combustion inhibitor in the first tank 18. The measurement result is transmitted to the adjusting unit 23. The adjusting unit 23 adjusts a flow rate of the combustion inhibitor 7 by opening/closing a valve 33 of a communication pipe 32 connecting the first and second tanks 18 and 19 to each other so that the combustion inhibitor 7 in the first tank 18 has constant capacity. The pipe between the first and second tanks 18 and 19 is kept warm at constant temperature.

The combustion inhibitor 7 has constant temperature, and the capacity of the combustion inhibitor 7 in the first tank 18 is maintained constant, so that the combustion inhibitor 7 applied onto the web W has constant viscosity. The quality of the web W passing through the dryer 4 can be then maintained constant, which makes constant the quality of the dried web W. A change in the shrinkage rate is therefore caused only by the influence of the dryer 4, meaning that the shrinkage rate of the web W can be accurately maintained constant simply by the control of the drying condition. The remaining amount of the combustion inhibitor 7 in the first tank 18 may be measured by measuring a liquid level in the tank or by any other method as long as the viscosity of the combustion inhibitor 7 is maintained constant.

Figure 3:
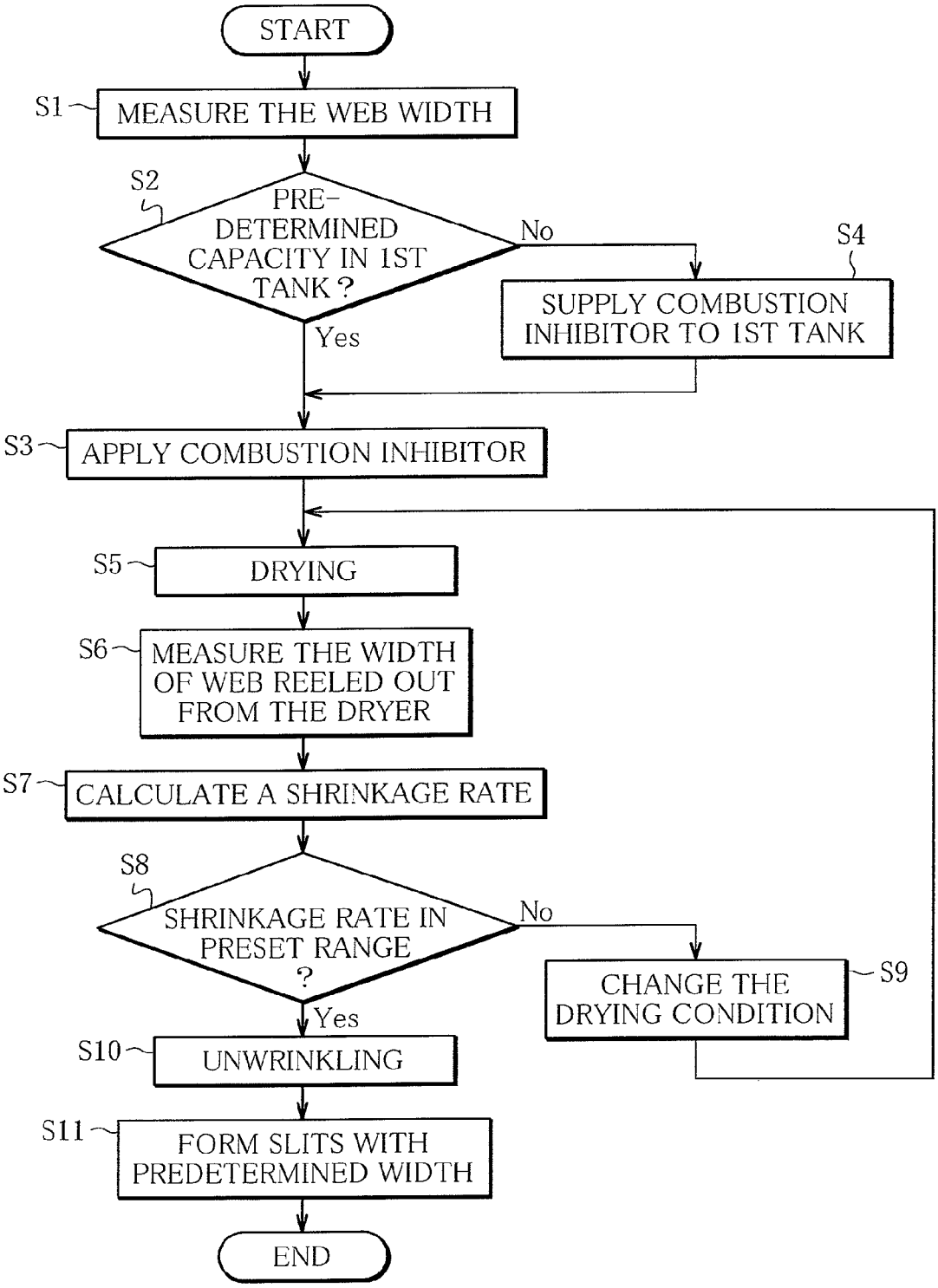
FIG. 3 is a flowchart showing the process of manufacturing wrapping paper by using the machine of manufacturing a low fire-spreading wrapping paper according to the invention.

A method of manufacturing a low fire-spreading wrapping paper using the manufacture machine 1 according to the invention will be described below with reference to FIG. 3. Reference marks in the following description are identical to those used in FIGS. 1 and 2.

Upon activation of the manufacturing machine 1, the web W is reeled out from the original roll and travels through the travel path 2, and the paper width of the web W is measured before the combustion inhibitor 7 is applied onto the web W (Step S1). After the web W enters the applier 3, the capacity measurer 22 carries out measurement to determine whether the capacity of the combustion inhibitor 7 in the first tank 18 is predetermined capacity (Step S2). If the capacity is the predetermined capacity, the combustion inhibitor 7 is directly applied onto the web W (Step S3). The web W is continuously applied with the combustion inhibitor 7, and travels through the travel path 2. To apply the combustion inhibitor 7 onto the web W reduces the capacity of the combustion inhibitor 7 in the first tank 18. The capacity of the combustion inhibitor 7 in the first tank 18 accordingly becomes equal to or less than the predetermined capacity. In order to maintain the constant capacity, the combustion inhibitor 7 is supplied from the second tank 19 to the first tank 18 (Step S4). The step of applying the combustion inhibitor 7 onto the web W is carried out while monitoring the capacity of the combustion inhibitor 7 in the first tank 18. To put it differently, while the web W is being applied with the combustion inhibitor 7 in the applier 3, Steps S2 to S4 are repeatedly performed.

The web W is directly subjected to the drying step in the dryer 4 (Step S5). Following the drying step, the width of the web W that is reeled out from the dryer 4, namely, the width of the dried web W, is measured (Step S6). On the basis of the width that has been measured, the shrinkage rate resulting from the drying of the web W is found by the calculation of the calculating section 11 (Step S7). Thereafter, the determining section 12 makes a determination as to whether the shrinkage rate is within the preset range (Step S8). If the shrinkage rate is within the preset range, the drying step is continued. If the shrinkage rate is outside the preset range, the drying condition is changed so that the shrinkage rate falls within the preset range (Step S9), and then, the drying step is continued. The controlling step including Steps S6 to S9 is repeated during the drying step, that is, until there is no undried web W left.

If there is no undried web W, the drying step in the dryer 4 is finished. To smooth the wrinkles of the shrunk web W, an unwrinkling step is carried out by the unwrinkling device 5 (Step S10). A slit-forming device 6 performs a slit-forming step, thereby forming slits with predetermined width in the web W and manufacturing rolls of wrapping paper 8 (Step S11).

REFERENCE MARKS

1 machine of manufacturing a low fire-spreading wrapping paper
2 travel path
3 applier
4 dryer
5 unwrinkling device
6 slit-forming device
7 combustion inhibitor
8 wrapping paper
9 sensor
10 controller
11 calculating section
12 determining section
13 controlling section
14 temperature indicator
15 hot-air supplier
16 moisture meter
18 first tank
19 second tank
20 supply path
21 application unit
22 capacity measurer
23 adjusting unit
24 pump
25 platen
26 gravure roller
27 furnisher roller
28 nozzle
29 doctor blade
30 recovery chute
31 weight scale
32 communication pipe
33 valve
34 sensor

The invention claimed is:

1. A cigarette wrapping paper manufacturing machine, comprising, a web, which is made of paper, said web travels along a travel path; an applicator interposed in the travel path, said applicator configured to apply a combustion inhibitor onto the web to form bands of the combustion inhibitor, the bands being arranged at intervals in a longitudinal direction of the web and extending across the web;

a dryer arranged at a location downstream of the applicator in the travel path, for drying the web which has received the combustion inhibitor;

a first detector arranged at a location downstream of the dryer in the travel path, for directly detecting a width of the web that has passed through the dryer; said first detector provides a detected width of the web to a controller, a second detector arranged at a location upstream of the applicator, for detecting the with of the web before drying, said controller programmed to obtain a shrinkage rate of a dried web, which is a section of the web which has passed through the dryer, and to change a drying condition of the dryer on the bass of the shrinkage rate so that the shrinkage rate of the dried web fails within an allowable range, the shrinkage rate affecting number of cigarette wrapping papers obtained from the web; and a slitter arranged at a location downstream of the dryer, for slitting the web into the cigarette wrapping papers, wherein the slitter silts the web along the longitudinal direction of the web to form the cigarette wrapping papers, and said controller includes a calculating section programmed to calculate the shrinkage rate with respect to a width direction of the web in accordance with the detected width of the web;

a determining section programmed to make a determination as to whether the shrinkage rate is within a preset range; and a controlling section programmed to change a drying condition of the dryer when the shrinkage rate is outside the preset range.

2. The machine according to claim 1, wherein the detector includes two displacement sensors disposed on both sides of the web, respectively, for detecting the width of the web.

3. The machine according to claim 2, wherein the displacement sensor is a CCD laser transmission sensor.

4. The machine according to claim 1, wherein the drying condition is drying temperature for the web.

5. The machine according to claim 3, wherein the drying temperature is a temperature in the dryer or hot-air temperature of hot air supplied into the dryer.

6. The machine according to claim 1, wherein the applicator includes:

an application unit for receiving the combustion inhibitor and directly applying onto the web the combustion inhibitor received;

first and second tanks communicating with each other and containing the combustion inhibitor;

a supply path for supplying the combustion inhibitor from the first tank to the application unit;

a measuring device for measuring residual quantity of the combustion inhibitor in the first tank while the combustion inhibitor is being applied onto the web by the application unit; and an adjusting unit for adjusting the residual quantity of the combustion inhibitor in the first tank by opening or closing a valve arranged in a communication pipe between the first and second tanks to supply the combustion inhibitor from the second tank to the first tank so that the residual quantity of the combustion inhibitor in the first tank, which is obtained by the measuring device, is constant.

7. The machine according to claim 2, further comprising a moisture meter arranged at a location downstream of the dryer in the travel path, for measuring a moisture content of the web.

* * * * *